US009880490B2

(12) United States Patent
Kuroda et al.

(10) Patent No.: US 9,880,490 B2
(45) Date of Patent: Jan. 30, 2018

(54) SEMICONDUCTIVE ROLLER FOR IMAGE DEVELOPING ROLLER

(71) Applicant: SUMITOMO RUBBER INDUSTRIES, LTD., Kobe-shi, Hyogo (JP)

(72) Inventors: Kenichi Kuroda, Kobe (JP); Kei Tajima, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/278,302

(22) Filed: Sep. 28, 2016

(65) Prior Publication Data

US 2017/0102635 A1 Apr. 13, 2017

(30) Foreign Application Priority Data

Oct. 13, 2015 (JP) ..... 2015-202238

(51) Int. Cl.
*G03G 15/08* (2006.01)

(52) U.S. Cl.
CPC ..... *G03G 15/0808* (2013.01); *G03G 15/0818* (2013.01)

(58) Field of Classification Search
None
See application file for complete search history.

(56) References Cited

U.S. PATENT DOCUMENTS

2006/0269327 A1* 11/2006 Mizumoto ..... G03G 15/0233 399/176
2013/0288869 A1 10/2013 Tajima

FOREIGN PATENT DOCUMENTS

JP 2007-106015 A 4/2007
JP 2013-231846 A 11/2013

* cited by examiner

*Primary Examiner* — Sevan A Aydin
(74) *Attorney, Agent, or Firm* — Birch, Stewart, Kolasch & Birch, LLP

(57) ABSTRACT

A nonporous semiconductive roller is provided, which constantly ensures proper image formation substantially without image density unevenness attributable to the roughness of an outer peripheral extrusion surface thereof when being used as a developing roller. The semiconductive roller (1) is made of a nonporous crosslinking product of a rubber composition which contains a rubber component including only four types of rubbers including an epichlorohydrin rubber, a chloroprene rubber, a butadiene rubber and an acrylonitrile butadiene rubber.

4 Claims, 1 Drawing Sheet

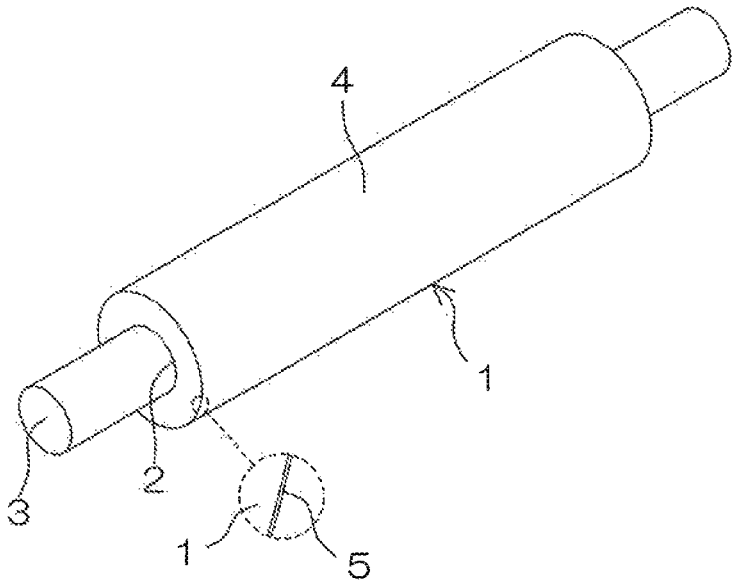
4
1
3
2
1
5

SEMICONDUCTIVE ROLLER FOR IMAGE DEVELOPING ROLLER

TECHNICAL FIELD

The present invention relates to a semiconductive roller to be used for an image forming apparatus, and particularly to a semiconductive roller to be advantageously used as a developing roller.

BACKGROUND ART

In an image forming apparatus, a semiconductive roller is used as a charging roller for uniformly electrically charging a surface of a photoreceptor body, as a developing roller for developing an electrostatic latent image formed by light-exposing the electrically charged photoreceptor surface into a toner image, as a transfer roller for transferring the formed toner image onto a paper sheet or the like, or as a cleaning roller for removing toner from the photoreceptor surface after the transfer of the toner image.

For improvement of the durability and the compression set properties of the semiconductive roller, the semiconductive roller is preferably formed of a nonporous crosslinking product of a rubber composition.

The semiconductive roller is produced, for example, by extruding the rubber composition into a nonporous tubular body, crosslinking the tubular body, inserting a shaft such as of a metal into a center through-hole of the tubular body, and polishing an outer peripheral surface of the tubular body.

In general, the rubber composition to be used as a material for the semiconductive roller is imparted with ion conductivity by using an ion-conductive rubber (e.g., an epichlorohydrin rubber) as a rubber component to be thereby imparted with semiconductivity as a whole.

Further, a diene rubber is generally used in combination with the ion-conductive rubber as the rubber component.

The diene rubber functions to improve the fluidity and the formability of the rubber composition in the extrusion, and to improve the smoothness of the outer peripheral extrusion surface of the nonporous tubular body produced by the extrusion to make the outer peripheral surface as smooth as possible without irregularity. Further, the diene rubber functions to improve the mechanical strength and the durability of the semiconductive roller and to improve the rubber characteristic properties of the semiconductive roller, i.e., to make the semiconductive roller more flexible and less susceptible to permanent compressive deformation with a reduced compression set. Furthermore, the diene rubber is oxidized by irradiation with ultraviolet radiation or the like, whereby an oxide film serving as a dielectric layer, a lower friction layer or the like is formed in the outer peripheral surface of the semiconductive roller as will be described later.

The diene rubber is excellent in these functions. Advantageously usable as the diene rubber are a butadiene rubber (BR) which is capable of properly electrically charging a positively-chargeable nonmagnetic single-component toner, and a chloroprene rubber (CR) which has the above functions and further functions to improve the flexibility of the semiconductive roller, to increase the nip width to increase the toner charging amount and to reduce the damage to the toner to improve the imaging durability.

If the proportion of the epichlorohydrin rubber is increased, for example, to improve the semiconductivity of the semiconductive roller, or if the proportion of the CR is increased and hence the proportion of the BR is relatively reduced in order to maintain the flexibility and the nip width of the semiconductive roller which tend to be reduced by the increase in the proportion of the epichlorohydrin rubber, however, the outer peripheral extrusion surface is liable to be roughened with the fluidity and the formability of the rubber composition reduced in the extrusion.

Even if the roughened outer peripheral extrusion surface is polished in the subsequent step, the semiconductive roller is problematically liable to cause image density unevenness, for example, when being used as the developing roller for image formation.

Where an automotive tire is produced by extrusion of a rubber composition, for example, a consideration is given to the shape of a back die of an extruder in order to improve an outer peripheral extrusion surface to make the outer peripheral surface as smooth as possible without irregularity (Patent Document 1 and the like).

Where the semiconductive roller or other OA system rubber component is produced by the extrusion, on the other hand, it is a general practice to increase the fluidity and the formability of the rubber composition, for example, by increasing the setting temperature of the extruder or by changing the shape of a die head.

CITATION LIST

Patent Document

[PATENT DOCUMENT 1] JP-2007-106015A

SUMMARY OF THE INVENTION

Problem to be Solved by the Invention

However, it is troublesome to change the shape and the structure of the die head every time the formulation of the rubber composition is changed. In addition, a rubber composition having a certain formulation cannot be dealt with only by the change of the die head. Further, if the setting temperature of the extruder is excessively high, the rubber composition is problematically liable to be scorched.

It is an object of the present invention to provide a nonporous semiconductive roller, which ensures proper image formation substantially without image density unevenness attributable to the roughness of an extrusion surface thereof, when being used as a developing roller.

Solution to Problem

According to the present invention, there is provided a semiconductive roller, which is made of a nonporous crosslinking product of a rubber composition containing a rubber component including only four types of rubbers including an epichlorohydrin rubber, a CR, a BR and an acrylonitrile butadiene rubber (NBR).

Effects of the Invention

According to the present invention, the semiconductive roller is nonporous and, when being used as a developing roller, ensures proper image formation substantially without image density unevenness attributable to extrusion surface roughness.

BRIEF DESCRIPTION OF THE DRAWING

FIGURE is a perspective view illustrating an exemplary semiconductive roller according to one embodiment of the present invention.

EMBODIMENTS OF THE INVENTION

A semiconductive roller according to the present invention is made of a nonporous crosslinking product of a rubber composition which contains a rubber component including only four types of rubbers including an epichlorohydrin rubber, a CR, a BR and an NBR.

The inventive semiconductive roller is produced by using the rubber composition containing the rubber component including the NBR as a diene rubber in addition to combination of the epichlorohydrin rubber, the CR and the BR, and extruding the rubber composition into a nonporous tubular body, whereby the outer peripheral extrusion surface of the tubular body can be substantially prevented from being roughened during the extrusion.

This is supposedly because the NBR serves as the diene rubber and has a solubility parameter (SP value) that is close to those of the epichlorohydrin rubber, the CR and the BR. That is, the NBR functions as a so-called compatibilizer to improve the homogeneity of the rubber composition, thereby improving the fluidity and the formability of the rubber composition.

Therefore, the semiconductive roller according to the present invention constantly ensures proper image formation substantially without image density unevenness attributable to the extrusion surface roughness particularly when being used as a developing roller.

<<Rubber Composition>>

<Rubber Component>

(Epichlorohydrin Rubber)

Various ion-conductive polymers each containing epichlorohydrin as a repeating unit are usable as the epichlorohydrin rubber.

Examples of the epichlorohydrin rubber include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used alone or in combination.

Of these epichlorohydrin rubbers, the ethylene oxide-containing copolymers, particularly the ECO and/or the GECO are preferred.

These copolymers preferably each have an ethylene oxide content of not less than 30 mol % and not greater than 80 mol %, particularly preferably not less than 50 mol %.

Ethylene oxide functions to reduce the roller resistance of the semiconductive roller. If the ethylene oxide content is less than the aforementioned range, however, it will be impossible to sufficiently provide this function and hence to sufficiently reduce the roller resistance.

If the ethylene oxide content is greater than the aforementioned range, on the other hand, ethylene oxide is liable to be crystallized, whereby the segment motion of molecular chains is hindered to adversely increase the roller resistance. Further, the semiconductive roller is liable to have an excessively high hardness after the crosslinking, and the rubber composition is liable to have a higher viscosity and, hence, poorer fluidity and formability when being heat-melted.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the semiconductive roller. However, if the allyl glycidyl ether content is less than the aforementioned range, it will be impossible to sufficiently provide this function and hence to sufficiently reduce the roller resistance.

Allyl glycidyl ether also functions as crosslinking sites during the crosslinking of the GECO. Therefore, if the allyl glycidyl ether content is greater than the aforementioned range, the crosslinking density of the GECO is excessively increased, whereby the segment motion of molecular chains is hindered to adversely increase the roller resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

The GECO is particularly preferred as the epichlorohydrin rubber. The GECO has double bonds, in its main chains, attributable to allyl glycidyl ether to function as the crosslinking sites and, therefore, reduces the compression set of the semiconductive roller by crosslinking between the main chains.

Therefore, the semiconductive roller is less liable to suffer from so-called permanent compressive deformation, for example, when being used as a developing roller. Thus, defective image formation such as the image density unevenness can be advantageously suppressed which may otherwise occur due to the permanent compressive deformation.

(CR)

The CR as the diene rubber is synthesized by emulsion polymerization of chloroprene, and may be classified in a sulfur modification type or a non-sulfur-modification type depending on the type of a molecular weight adjusting agent to be used for the emulsion polymerization.

The sulfur modification type CR is synthesized by plasticizing a copolymer of chloroprene and sulfur (molecular weight adjusting agent) with thiuram disulfide or the like to adjust the viscosity of the copolymer to a predetermined viscosity level.

The non-sulfur-modification type CR may be classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent.

The xanthogen modification type CR is synthesized in substantially the same manner as the sulfur modification type CR, except that an alkyl xanthogen compound is used as the molecular weight adjusting agent.

Further, the CR may be classified in a lower crystallization speed type, an intermediate crystallization speed type or a higher crystallization speed type depending on the crystallization speed.

In the present invention, any of the aforementioned types of CRs may be used. Particularly, a CR of the non-sulfur-modification type and the lower crystallization speed type is preferred.

Further, a copolymer of chloroprene and other comonomer may be used as the CR. Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used alone or in combination.

The CR may be classified in an oil-extension type having flexibility controlled by addition of an extension oil or a non-oil-extension type containing no extension oil. Either type of CR is usable.

(BR)

Various crosslinkable polymers each having a polybutadiene structure in a molecule thereof are usable as the BR. Particularly, a higher cis-content BR which has a cis-1,4 bond content of not less than 90 mass % and is flexible and capable of forming a crosslinking product having a lower compression set is preferred.

The BR may be classified in an oil-extension type having flexibility controlled by addition of an extension oil or a non-oil-extension type containing no extension oil. Either type of BR is usable.

(NBR)

The NBR may be classified in a lower acrylonitrile content type having an acrylonitrile content of not greater than 24%, an intermediate acrylonitrile content type having an acrylonitrile content of 25 to 30%, an intermediate and higher acrylonitrile content type having an acrylonitrile content of 31 to 35%, a higher acrylonitrile content type having an acrylonitrile content of 36 to 42%, or a very high acrylonitrile content type having an acrylonitrile content of not lower than 43%. Any of these types of NBRs are usable.

Further, the NBR may be classified in an oil-extension type having flexibility controlled by addition of an extension oil or anon-oil-extension type containing no extension oil. Either type of NBR is usable.

In order to improve the fluidity of the rubber composition, it is preferred to select an NBR having a lower Mooney viscosity. More specifically, the Mooney viscosity $ML_{1+4}$ (100° C.) of the NBR is preferably not greater than 35. The lower limit of the Mooney viscosity is not particularly limited, and an NBR having the lowest available Mooney viscosity may be used. Further, various solid NBRs are usable.

Instead of the solid NBRs, liquid NBRs which are liquid at an ordinary temperature are also usable.

(Proportions of Ingredients to be Blended)

The proportion of the epichlorohydrin rubber of the rubber component is preferably not less than 15 parts by mass and not greater than 65 parts by mass, particularly preferably not less than 20 parts by mass and not greater than 60 parts by mass, based on 100 parts by mass of the overall rubber component.

If the proportion of the epichlorohydrin rubber is less than the aforementioned range, it will be impossible to impart the semiconductive roller with proper semiconductivity.

If the proportion of the epichlorohydrin rubber is greater than the aforementioned range, on the other hand, the proportion of the CR is relatively reduced, making it impossible to sufficiently provide the effect of the blending of the CR for improving the flexibility of the semiconductive roller and increasing the nip width. Further, the proportions of the BR and the NBR are reduced, thereby reducing the fluidity and the formability of the rubber composition and roughening the outer peripheral extrusion surface.

Where the proportion of the epichlorohydrin rubber falls within the aforementioned range, in contrast, it is possible to impart the semiconductive roller with proper semi conductivity while providing the effect of the combinational use of the aforementioned three diene rubbers.

The proportion of the CR is preferably not less than 5 parts by mass and not greater than 45 parts by mass, particularly preferably not less than 10 parts by mass and not greater than 40 parts by mass, based on 100 parts by mass of the overall rubber component.

If the proportion of the CR is less than the aforementioned range, it will be impossible to sufficiently provide the effect of the blending of the CR for improving the flexibility of the semiconductive roller and increasing the nip width.

If the proportion of the CR is greater than the aforementioned range, on the other hand, the proportion of the epichlorohydrin rubber is relatively reduced, making it impossible to impart the semiconductive roller with proper semiconductivity. Further, the proportions of the BR and the NBR are reduced, thereby reducing the fluidity and the formability of the rubber composition and roughening the outer peripheral extrusion surface.

Where the proportion of the CR falls within the aforementioned range, in contrast, it is possible to improve the flexibility and to increase the nip width, while providing the effect of the combinational use of the other three rubbers. Thus, the toner chargeability and the imaging durability can be further improved when the semiconductive roller is used as a developing roller.

Where the oil-extension type CR is used as the CR, the proportion of the CR is the solid proportion of the CR contained in the oil-extension type CR.

The proportion of the BR is basically a balance obtained by subtracting the proportions of the other three rubbers from the total. That is, the proportion of the BR is such that the predetermined proportions of the epichlorohydrin rubber, the CR and the NBR plus the proportion of the BR equal to 100 parts by mass of the overall rubber component.

More specifically, the proportion of the BR is preferably not less than 20 parts by mass and not greater than 60 parts by mass, particularly preferably not less than 25 parts by mass and not greater than 55 parts by mass, based on 100 parts by mass of the overall rubber component.

If the proportion of the BR is less than the aforementioned range, the amount of the BR mainly serving for the fluidity and the formability of the rubber composition is insufficient. Even with the blending of the NBR, the fluidity and the formability are liable to be reduced, thereby roughening the outer peripheral extrusion surface.

If the proportion of the BR is greater than the aforementioned range, on the other hand, the proportion of the epichlorohydrin rubber is relatively reduced, making it impossible to impart the semiconductive roller with proper semiconductivity. Further, the proportion of the CR is reduced, making it impossible to sufficiently provide the effect of the blending of the CR for improving the flexibility of the semiconductive roller and increasing the nip width. Further, the proportion of the NBR is reduced, making it impossible to sufficiently provide the effect of the blending of the NBR for improving the homogeneity of the rubber composition to improve the fluidity and the formability of the rubber composition. This may adversely roughen the outer peripheral extrusion surface.

Where the proportion of the BR falls within the aforementioned range, in contrast, it is possible to improve the fluidity and the formability of the rubber composition and to suppress the roughening of the extrusion surface in the extrusion, while providing the effect of the combinational use of the other three rubbers.

Where the oil-extension type BR is used as the BR, the proportion of the BR is the solid proportion of the BR contained in the oil-extension type BR.

The proportion of the NBR is preferably set in consideration of the proportion of the BR which particularly functions to improve the fluidity and the formability of the rubber composition.

Where the proportion of the BR is not greater than 55 parts by mass based on 100 parts by mass of the overall rubber component, for example, the proportion of the NBR is preferably not less than 3 parts by mass and not greater than 15 parts by mass, particularly preferably not less than 5 parts by mass and not greater than 10 parts by mass, based on 100 parts by mass of the overall rubber component.

If the proportion of the NBR is less than the aforementioned range, it will be impossible to sufficiently provide the effect of the blending of the NBR for improving the homogeneity of the rubber composition to improve the fluidity and the formability of the rubber composition. This may roughen the outer peripheral extrusion surface.

If the proportion of the NBR is greater than the aforementioned range, on the other hand, the proportion of the epichlorohydrin rubber is relatively reduced, making it impossible to impart the semiconductive roller with proper semiconductivity. Further, the proportion of the CR is reduced, making it impossible to sufficiently provide the effect of the blending of the CR for improving the flexibility of the semiconductive roller and increasing the nip width. Further, the proportion of the BR mainly serving for the fluidity and the formability of the rubber composition is reduced. Even with the blending of the NBR, the fluidity and the formability are liable to be reduced, thereby roughening the outer peripheral extrusion surface.

Where the proportion of the NBR falls within the aforementioned range, in contrast, it is possible to improve the fluidity and the formability of the rubber composition and to suppress the roughening of the extrusion surface in the extrusion, while providing the effect of the combinational use of the other three rubbers.

Where the oil-extension type NBR is used as the NBR, the proportion of the NBR is the solid proportion of the NBR contained in the oil-extension type NBR.

<Crosslinking Component>

The rubber composition contains a crosslinking component for crosslinking the rubber component. The crosslinking component includes a crosslinking agent and an accelerating agent.

Examples of the crosslinking agent include a sulfur crosslinking agent, a thiourea crosslinking agent, a triazine derivative crosslinking agent, a peroxide crosslinking agent and monomers, which may be used alone or in combination.

Examples of the sulfur crosslinking agent include sulfur powder and organic sulfur-containing compounds. Examples of the organic sulfur-containing compounds include tetramethylthiuram disulfide and N,N-dithiobismorpholine.

Examples of the thiourea crosslinking agent include tetramethylthiourea, trimethylthiourea, ethylene thiourea, and thioureas represented by $(C_nH_{2n+1}NH)_2C{=}S$ (wherein n is a number of 1 to 10), which may be used alone or in combination.

Examples of the peroxide crosslinking agent include benzoyl peroxide and the like.

Sulfur such as the sulfur powder and the thiourea crosslinking agent are preferably used in combination as the crosslinking agent.

The proportion of the sulfur to be used in combination with the thiourea crosslinking agent is preferably not less than 0.5 parts by mass and not greater than 2 parts by mass based on 100 parts by mass of the overall rubber component.

If the proportion of the sulfur is less than the aforementioned range, the crosslinking speed of the overall rubber composition will be reduced, requiring a longer period of time for the crosslinking. This may reduce the productivity of the semiconductive roller.

If the proportion of the sulfur is greater than the aforementioned range, on the other hand, the semiconductive roller is liable to have a greater compression set after the crosslinking, and an excess amount of the sulfur is liable to bloom on the outer peripheral surface of the semiconductive roller to contaminate a photoreceptor body and the like.

Where oil-containing sulfur powder is used, the proportion of the sulfur is the effective proportion of sulfur contained in the oil-containing sulfur powder.

The proportion of the thiourea crosslinking agent to be blended is preferably not less than 0.2 parts by mass and not greater than 1 part by mass based on 100 parts by mass of the overall rubber component.

Where the thiourea crosslinking agent is used in the aforementioned thiourea proportion in combination with the sulfur, the proportion of the sulfur can be relatively reduced within the aforementioned sulfur range, thereby reducing the compression set of the semiconductive roller.

Further, the thiourea crosslinking agent hardly hinders the molecular motion of the rubber, so that the roller resistance of the semiconductive roller can be reduced. Particularly, as the proportion of the thiourea crosslinking agent is increased within the aforementioned thiourea range to increase the crosslinking density, the roller resistance of the semiconductive roller is reduced.

However, if the proportion of the thiourea crosslinking agent is less than the aforementioned range, it will be impossible to sufficiently provide the effects of the combinational use of the thiourea crosslinking agent and the sulfur.

If the proportion of the thiourea crosslinking agent is greater than the aforementioned range, on the other hand, an excess amount of the thiourea crosslinking agent is liable to bloom on the outer peripheral surface of the semiconductive roller to contaminate the photoreceptor body and the like, thereby deteriorating the breaking elongation property and other mechanical properties of the semiconductive roller.

Examples of the accelerating agent include inorganic accelerating agents such as lime, magnesia (MgO) and litharge (PbO), and organic accelerating agents, which may be used alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used alone or in combination.

Different types of accelerating agents have different functions and, therefore, are preferably used in combination.

The proportion of each of the accelerating agents to be blended may be properly determined depending on the type of the accelerating agent, but is typically not less than 0.2 parts by mass and not greater than 2 parts by mass based on 100 parts by mass of the overall rubber component.

<Other Ingredients>

As required, various additives may be added to the rubber composition. Examples of the additives include an acceleration assisting agent, an acid accepting agent, a plasticizing agent, a processing aid, a degradation preventing agent, a filler, an anti-scorching agent, a lubricant, a pigment, an anti-static agent, a flame retarder, a neutralizing agent, a nucleating agent and a co-crosslinking agent.

Examples of the acceleration assisting agent include: metal compounds such as zinc oxide (zinc white); fatty acids such as stearic acid, oleic acid and cotton seed fatty acids; and other conventionally known acceleration assisting agents, which may be used alone or in combination.

The proportion of the acceleration assisting agent to be added is preferably not less than 0.5 parts by mass and not greater than 7 parts by mass based on 100 parts by mass of the overall rubber component. The proportion of the acceleration assisting agent may be properly determined within the aforementioned range depending on the types of the rubbers of the rubber component, the types of the crosslinking agent and the accelerating agent to be used in combination.

In the presence of the acid accepting agent, chlorine-containing gases generated from the epichlorohydrin rubber and the CR during the crosslinking of the rubber component are prevented from remaining in the semiconductive roller. Thus, the acid accepting agent functions to prevent the inhibition of the crosslinking and the contamination of the photoreceptor body and the like, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the inhibition of the crosslinking and the contamination of the photoreceptor body and the like.

The proportion of the acid accepting agent to be added is preferably not less than 0.5 parts by mass and not greater than 4 parts by mass based on 100 parts by mass of the overall rubber component.

If the proportion of the acid accepting agent is less than the aforementioned range, it will be impossible to sufficiently provide the effect of the addition of the acid accepting agent. If the proportion of the acid accepting agent is greater than the aforementioned range, the semiconductive roller is liable to have a higher hardness after the crosslinking.

Examples of the plasticizing agent include plasticizers such as dibutyl phthalate (DBP), dioctyl phthalate (DOP) and tricresyl phosphate, and waxes such as polar waxes. Examples of the processing aid include fatty acids such as stearic acid.

The proportion of the plasticizing agent and/or the processing aid to be added is preferably not greater than 5 parts by mass based on 100 parts by mass of the overall rubber component. This prevents the contamination of the photoreceptor body and the like, for example, when the semiconductive roller is mounted in an image forming apparatus or when the image forming apparatus is operated. For this purpose, it is particularly preferred to use any of the polar waxes out of the plasticizing agents.

Examples of the degradation preventing agent include various anti-aging agents and anti-oxidants.

The anti-oxidants serve to reduce the environmental dependence of the roller resistance of the semiconductive roller and to suppress the increase in roller resistance during continuous energization of the semiconductive roller. Examples of the anti-oxidants include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

Examples of the filler include zinc oxide, silica, carbon, carbon black, clay, talc, calcium carbonate, magnesium carbonate and aluminum hydroxide, which may be used alone or in combination.

The mechanical strength and the like of the semiconductive roller can be improved by the addition of the filler.

The proportion of the filler to be added is preferably not less than 2 parts by mass and not greater than 20 parts by mass based on 100 parts by mass of the overall rubber component.

An electrically conductive filler such as an electrically conductive carbon black may be added as the filler to the rubber composition to impart the semiconductive roller with electron conductivity.

The proportion of the electrically conductive carbon black to be added is preferably not less than 1 part by mass and not greater than 3 parts by mass based on 100 parts by mass of the overall rubber component.

Examples of the anti-scorching agent include N-cyclohexylthiophthalimide, phthalic anhydride, N-nitrosodiphenylamine and 2,4-diphenyl-4-methyl-1-pentene, which may be used alone or in combination. Particularly, N-cyclohexylthiophthalimide is preferred.

The proportion of the anti-scorching agent to be added is preferably not less than 0.1 part by mass and not greater than 5 parts by mass based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used alone or in combination.

Examples of the ethylenically unsaturated monomers include:

(a) monocarboxylic acids such as acrylic acid, methacrylic acid and crotonic acid;

(b) dicarboxylic acids such as maleic acid, fumaric acid and itaconic acid;

(c) esters and anhydrides of the unsaturated carboxylic acids (a) and (b);

(d) metal salts of the monomers (a) to (c);

(e) aliphatic conjugated dienes such as 1,3-butadiene, isoprene and 2-chloro-1,3-butadiene;

(f) aromatic vinyl compounds such as styrene, α-methylstyrene, vinyltoluene, ethylvinylbenzene and divinylbenzene;

(g) vinyl compounds such as triallyl isocyanurate, triallyl cyanurate and vinylpyridine each having a hetero ring; and (h) cyanovinyl compounds such as (meth)acrylonitrile and α-chloroacrylonitrile, acrolein, formyl sterol, vinyl methyl ketone, vinyl ethyl ketone and vinyl butyl ketone. These ethylenically unsaturated monomers (a) to (h) may be used alone or in combination.

Monocarboxylic acid esters are preferred as the esters (c) of the unsaturated carboxylic acids.

Specific examples of the monocarboxylic acid esters include:

alkyl (meth)acrylates such as methyl (meth)acrylate, ethyl (meth)acrylate, n-propyl (meth)acrylate, i-propyl (meth) acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl(meth)acrylate, dodecyl (meth)acrylate, hydroxymethyl (meth)acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth)acrylates such as glycidyl (meth)acrylate, methaglycidyl (meth)acrylate and epoxycyclohexyl (meth)acrylate each having an epoxy group;

(meth)acrylates such as N-methylol (meth)acrylamide, γ-(meth)acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used alone or in combination.

The rubber composition containing the ingredients described above can be prepared in a conventional manner. First, the rubbers for the rubber component are blended in the predetermined proportions, and the resulting rubber component is simply kneaded. After additives other than the crosslinking component are added to and kneaded with the rubber component, the crosslinking component is finally added to and further kneaded with the resulting mixture. Thus, the rubber composition is provided. A kneader, a Banbury mixer, or an extruder, for example, is usable for the kneading.

<<Semiconductive Roller>>

FIGURE is a perspective view illustrating an exemplary semiconductive roller according to one embodiment of the present invention.

Referring to FIGURE, the semiconductive roller 1 according to this embodiment includes a tubular body formed from the aforementioned rubber composition and having a nonporous single-layer structure, and a shaft 3 is inserted through a center through-hole 2 of the tubular body and fixed to the through-hole 2.

The shaft 3 is a unitary member made of a metal such as aluminum, an aluminum alloy or a stainless steel.

The shaft 3 is electrically connected to and mechanically fixed to the semiconductive roller 1, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the semiconductive roller 1. Thus, the shaft 3 and the semiconductive roller 1 are unitarily rotatable.

The semiconductive roller 1 may have an oxide film 5 provided in an outer peripheral surface 4 thereof as shown in FIGURE on an enlarged scale.

The oxide film 5 thus provided functions as a dielectric layer to reduce the dielectric dissipation factor of the semiconductive roller 1. Further, the oxide film 5 serves as a lower friction layer which advantageously suppresses the adhesion of the toner when the semiconductive roller 1 is used as a developing roller.

In addition, the oxide film 5 can be easily formed, as described above, through the oxidation of the diene rubbers of the rubber composition in the outer peripheral surface 4, for example, by irradiating the outer peripheral surface 4 with ultraviolet radiation in an oxidizing atmosphere. This suppresses the reduction in the productivity of the semiconductive roller 1 and the increase in the production costs of the semiconductive roller 1.

The term "single-layer structure" of the semiconductive roller 1 means that the semiconductive roller 1 includes a single layer formed from the rubber composition and the oxide film 5 formed by the irradiation with the ultraviolet radiation is not counted.

For production of the semiconductive roller 1, the rubber composition preliminarily prepared is first extruded into a tubular body by means of an extruder. Then, the tubular body is cut to a predetermined length, and pressurized and heated in a vulcanization can to be thereby crosslinked.

In turn, the crosslinked tubular body is heated in an oven or the like for secondary crosslinking, then cooled, and polished to a predetermined outer diameter.

Various polishing methods such as a dry traverse polishing method may be used for the polishing. Where the outer peripheral surface is mirror-finished at the final stage of the polishing process, the outer peripheral surface is improved in releasability, and is substantially free from the adhesion of the toner even without the formation of the oxide film 5. This effectively prevents the contamination of the photoreceptor body and the like.

Where the oxide film 5 is formed in the outer peripheral surface after the mirror-finishing of the outer peripheral surface, the synergistic effect of the mirror-finishing and the formation of the oxide film 5 more advantageously suppresses the adhesion of the toner, and further advantageously prevents the contamination of the photoreceptor body and the like.

The shaft 3 may be inserted into and fixed to the through-hole 2 at any time between the end of the cutting of the tubular body and the end of the polishing.

However, the tubular body is preferably secondarily crosslinked and polished with the shaft 3 inserted through the through-hole 2 after the cutting. This prevents warpage and deformation of the semiconductive roller 1 which may otherwise occur due to expansion and contraction of the tubular body in the secondary crosslinking. Further, the tubular body may be polished while being rotated about the shaft 3. This improves the working efficiency in the polishing, and suppresses deflection of the outer peripheral surface 4.

As previously described, the shaft 3 having an outer diameter greater than the inner diameter of the through-hole 2 may be press-inserted into the through-hole 2, or the shaft 3 may be inserted through the through-hole 2 of the tubular body with the intervention of an electrically conductive thermosetting adhesive agent before the secondary crosslinking.

In the latter case, the thermosetting adhesive agent is cured when the tubular body is secondarily crosslinked by the heating in the oven. Thus, the shaft 3 is electrically connected to and mechanically fixed to the semiconductive roller 1.

In the former case, the electrical connection and the mechanical fixing are achieved simultaneously with the press insertion.

As described above, the formation of the oxide film 5 is preferably achieved by the irradiation of the outer peripheral surface 4 of the semiconductive roller 1 with the ultraviolet radiation. That is, this method is simple and efficient, because the formation of the oxide film 5 is achieved simply through the oxidation of the diene rubbers of the rubber composition present in the outer peripheral surface 4 by irradiating the outer peripheral surface 4 of the semiconductive roller 1 with ultraviolet radiation having a predetermined wavelength for a certain period of time.

Since the formation of the oxide film 5 is achieved through the oxidation of the diene rubbers of the rubber composition present in the outer peripheral surface 4 by the irradiation with the ultraviolet radiation, as described above, the resulting oxide film 5 is free from problems associated with a conventional film formation method in which a coating film is formed by applying a coating agent, and is highly uniform in thickness and surface geometry.

The wavelength of the ultraviolet radiation to be used for the irradiation is preferably not less than 100 nm and not greater than 400 nm, particularly preferably not greater than 300 nm, for efficient oxidation of the diene rubbers and for the formation of the oxide film 5 excellent in the aforementioned functions. The irradiation period is preferably not shorter than 30 seconds and not longer than 30 minutes, particularly preferably not shorter than 1 minute and not longer than 15 minutes.

The oxide film 5 may be formed by other methods, or may be obviated in some case.

The semiconductive roller 1 having the nonporous single-layer structure preferably has a Type-A durometer hardness of not greater than 60, particularly preferably not greater than 50.

A semiconductive roller having a Type-A durometer hardness greater than the aforementioned range is liable to be insufficient in toner chargeability and imaging durability with poorer flexibility and a smaller nip width when being used as a developing roller.

In the present invention, the Type-A durometer hardness is measured at a temperature of 23±2° C. in conformity with Japanese Industrial Standards JIS K6253-$3_{2012}$.

The semiconductive roller 1 preferably has a roller resistance R of not less than $10^4\Omega$ and not greater than $10^8\Omega$, particularly preferably not less than $10^{6.5}\Omega$, as measured at a temperature of 23±2° C. at a relative humidity of 55±2% with an application voltage of 1000 V, when being used as a developing roller.

A semiconductive roller having a roller resistance R lower than the aforementioned range is liable to leak the charge of the toner when being used as a developing roller. If the charge is leaked along the surface, for example, the image resolution is liable to be reduced.

A semiconductive roller having a roller resistance R higher than the aforementioned range will problematically fail to properly form an image having a sufficient image density when being used as a developing roller.

The hardness, the roller resistance, the compression set and the like of the semiconductive roller 1 may be controlled, for example, by adjusting the proportions of the four types of rubbers within the aforementioned ranges, adjusting the types and the proportions of the crosslinking component, or adjusting the types and the proportions of the filler and other additives.

The inventive semiconductive roller is not limited to that having the single-layer structure including the single layer as described above, but may have a multi-layer structure including two layers, i.e., an outer layer adjacent to the outer peripheral surface 4 and an inner layer adjacent to the shaft 3.

In this case, the outer layer adjacent to the outer peripheral surface 4 is formed from the aforementioned rubber composition, whereby the outer peripheral extrusion surface is substantially prevented from being roughened during the extrusion for the formation of the outer layer. Thus, the semiconductive roller advantageously suppresses the image density unevenness, for example, when being used as the transfer roller.

The inventive semiconductive roller 1 is incorporated in an electrophotographic image forming apparatus such as a laser printer to be advantageously used as a developing roller for developing an electrostatic latent image formed on a surface of a photoreceptor body into a toner image with an electrically charged toner, particularly with a positively-chargeable nonmagnetic single-component toner.

The semiconductive roller 1 preferably has a thickness of not less than 1 mm and not greater than 10 mm, particularly preferably not less than 3 mm and not greater than 7 mm, so as to achieve size reduction and weight reduction and to maintain a proper nip width, for example, when being used as a developing roller.

The inventive semiconductive roller can be advantageously used as a developing roller in an image forming apparatus such as a laser printer, an electrostatic copying machine, a plain paper facsimile machine or a printer-copier-facsimile multifunction machine, and can also be used as a charging roller, a transfer roller, a cleaning roller or the like in the image forming apparatus.

EXAMPLES

Example 1

(Preparation of Rubber Composition)

The following four types of rubbers were used for a rubber component.

32 parts by mass of a GECO (EPION (registered trade name) 301L available from Daiso Co., Ltd. and having a molar ratio of EO/EP/AGE=73/23/4)

10 parts by mass of a CR (SHOPRENE (registered trade name) WRT available from Showa Denko K.K.)

3 parts by mass of an NBR (lower acrylonitrile content NBR Nipol (registered trade name) DN401LL available from Nippon Zeon Corporation, and having an acrylonitrile content of 18% and a Mooney viscosity $ML_{1+4}$(100° C.) of 32)

55 parts by mass of a BR (JSR BR01 available from JSR Co., Ltd., and having a cis-1,4 bond content of 95 mass % and a Mooney viscosity $ML_{1+4}$(100° C.) of 45)

While 100 parts by mass of the rubber component containing the four types of rubbers was simply kneaded by means of a Banbury mixer, ingredients other than the crosslinking component shown below in Table 1 were added to and kneaded with the rubber component. Then, the crosslinking component was finally added to and kneaded with the resulting mixture. Thus, a rubber composition was prepared.

TABLE 1

| Ingredients | Parts by mass |
|---|---|
| Sulfur crosslinking agent | 1.05 |
| Thiuram accelerating agent | 0.50 |
| Thiazole accelerating agent | 1.50 |
| Thiourea crosslinking agent | 0.33 |
| Guanidine accelerating agent | 0.28 |
| Acceleration assisting agent | 5.0 |
| Filler I | 5.0 |
| Filler II | 2.0 |
| Acid accepting agent | 3.0 |

The ingredients shown in Table 1 are as follows. Sulfur crosslinking agent: 5% oil-containing sulfur (available from Tsurumi Chemical Industry Co., Ltd.) Thiuram accelerating agent: Tetramethylthiuram monosulfide (SANCELER (registered trade name) TS available from Sanshin Chemical Industry Co., Ltd.) Thiazole accelerating agent: Di-2-benzothiazyl disulfide (SUNSINE MBTS (trade name) available from Shandong Shanxian Chemical Co., Ltd.)
Thiourea crosslinking agent: Ethylene thiourea (2-mercaptoimidazoline ACCEL (registered trade name) 22-S available from Kawaguchi Chemical Industry Co., Ltd.)
Guanidine accelerating agent: 1,3-di-o-tolylguanidine (SANCELER DT available from Sanshin Chemical Industry Co., Ltd.)
Acceleration assisting agent: Zinc oxide Type-2 (available from Mitsui Mining & Smelting Co., Ltd.)
Filler I: Carbon black FT (ASAHI #15 available from Asahi Carbon Co., Ltd.)
Filler II: Electrically conductive carbon black (DENKA BLACK (registered trade name) particles available from Denki Kagaku Kogyo K.K.)
Acid accepting agent: Hydrotalcites (DHT-4A (registered trade name) available from Kyowa Chemical Industry Co., Ltd.)
(Production of Semiconductive Roller)

The rubber composition thus prepared was fed into an extruder, and extruded into a tubular body having an outer diameter of 20 mm and an inner diameter of 7.0 mm. Then, the tubular body was fitted around a temporary crosslinking shaft, and crosslinked in a vulcanization can at 160° C. for 1 hour.

Then, the crosslinked tubular body was removed from the temporary shaft, then fitted around a shaft having an outer diameter of 7.5 mm and an outer peripheral surface to which an electrically conductive thermosetting adhesive agent was applied, and heated in an oven at 160° C. Thus, the tubular body was bonded to the shaft.

In turn, opposite end portions of the tubular body were cut, and the outer peripheral surface of the resulting tubular body was traverse-polished by means of a cylindrical polishing machine, and then mirror-polished to an outer diameter of 20.00 mm (with a tolerance of 0.05). For the mirror-polishing, a #2000 lapping film (MIRROR FILM (registered trade name) available from Sankyo-Rikagaku Co., Ltd.) was used.

After the mirror-polished outer peripheral surface was washed with water, the tubular body was set in a UV irradiation apparatus (PL21-200 available from Sen Lights Corporation) with the outer peripheral surface spaced 5 cm from a UV lamp. Then, the tubular body was rotated about the shaft by 90 degrees at each time, and each 90-degree angular range of the outer peripheral surface was irradiated with ultraviolet radiation at wavelengths of 184.9 nm and 253.7 nm for 5 minutes. Thus, an oxide film was formed in the entire outer peripheral surface. In this manner, a semiconductive roller was produced.

Example 2

A rubber composition was prepared in substantially the same manner as in Example 1, except that the proportion of the GECO was 30 parts by mass and the proportion of the NBR was 5 parts by mass. Then, a semiconductive roller was produced by using the rubber composition thus prepared.

Example 3

A rubber composition was prepared in substantially the same manner as in Example 1, except that the proportion of the GECO was 40 parts by mass, the proportion of the NBR was 5 parts by mass and the proportion of the BR was 45 parts by mass. Then, a semiconductive roller was produced by using the rubber composition thus prepared.

Example 4

A rubber composition was prepared in substantially the same manner as in Example 1, except that the proportion of the GECO was 40 parts by mass, the proportion of the NBR was 10 parts by mass and the proportion of the BR was 40 parts by mass. Then, a semiconductive roller was produced by using the rubber composition thus prepared.

Example 5

A rubber composition was prepared in substantially the same manner as in Example 1, except that the proportion of the GECO was 20 parts by mass, the proportion of the CR was 40 parts by mass, the proportion of the NBR was 10 parts by mass and the proportion of the BR was 30 parts by mass. Then, a semiconductive roller was produced by using the rubber composition thus prepared.

Example 6

A rubber composition was prepared in substantially the same manner as in Example 1, except that the proportion of the GECO was 60 parts by mass, the proportion of the CR was 10 parts by mass, the proportion of the NBR was 5 parts by mass and the proportion of the BR was 25 parts by mass. Then, a semiconductive roller was produced by using the rubber composition thus prepared.

Example 7

A rubber composition was prepared in substantially the same manner as in Example 2, except that N250SL (lower acrylonitrile content NBR having an acrylonitrile content of 19.5%) having a Mooney viscosity $ML_{1+4}$ (100° C.) of 43 and available from JSR Co., Ltd. was used in the same proportion. Then, a semiconductive roller was produced by using the rubber composition thus prepared.

Comparative Example 1

A rubber composition was prepared in substantially the same manner as in Example 1, except that the proportion of the GECO was 35 parts by mass and the NBR was not blended. Then, a semiconductive roller was produced by using the rubber composition thus prepared.

<Actual Machine Test>

A new toner cartridge (unitarily including a toner container containing toner, a photoreceptor body and a developing roller kept in contact with the photoreceptor body) for a commercially available laser printer was prepared. The semiconductive rollers produced in Examples and Comparative Examples were each incorporated as a developing roller instead of the original developing roller in the toner cartridge. The laser printer employed a positively-chargeable nonmagnetic single-component toner, and had a printing sheet number of 8000 recommended for the toner.

After the toner cartridge was mounted in the laser printer in an initial state, a black solid image was printed as an initial image at a temperature of 23±1° C. at a relative humidity of 55±1% by means of the laser printer, and visually checked for image defect (image density unevenness) attributable to the extrusion surface roughness on the basis of the following criteria.

○ (Excellent): No density unevenness was observed.

Δ (Practically acceptable): Visually unperceivable slight density unevenness was observed.

× (Unacceptable): Visually perceivable density unevenness was observed.

The results are shown in Tables 2 and 3.

TABLE 2

| | Comparative Example 1 | Example 1 | Example 2 | Example 3 |
|---|---|---|---|---|
| | Parts by mass | | | |
| GECO | 35 | 32 | 30 | 40 |
| CR | 10 | 10 | 10 | 10 |
| NBR ($ML_{1+4}$: 32) | — | 3 | 5 | 5 |
| NBR ($ML_{1+4}$: 43) | — | — | — | — |
| BR | 55 | 55 | 55 | 45 |
| Initial image evaluation | x | Δ | ○ | ○ |

TABLE 3

| | Example 4 | Example 5 | Example 6 | Example 7 |
|---|---|---|---|---|
| | Parts by mass | | | |
| GECO | 40 | 20 | 60 | 30 |
| CR | 10 | 40 | 10 | 10 |
| NBR ($ML_{1+4}$: 32) | 10 | 10 | 5 | — |
| NBR ($ML_{1+4}$: 43) | — | — | — | 5 |
| BR | 40 | 30 | 25 | 55 |
| Initial image evaluation | ○ | ○ | ○ | Δ |

The results for Examples 1 to 7 and Comparative Example 1 shown in Tables 2 and 3 indicate that, where a rubber composition containing an NBR as a diene rubber in addition to the combination of an epichlorohydrin rubber, a CR and a BR is extruded into a nonporous tubular body, the outer peripheral extrusion surface of the extruded tubular body is substantially free from roughness, and the semiconductive roller formed from the rubber composition constantly ensures proper image formation substantially without image density unevenness attributable to the roughness of the extrusion surface when being used as a developing roller.

The results for Examples 1 to 6 indicate that, where the proportion of the BR is not greater than 55 parts by mass based on 100 parts by mass of the overall rubber component, the proportion of the NBR is preferably not less than 3 parts by mass, particularly preferably not less than 5 parts by mass.

Further, the results for Examples 2 and 7 indicate that an NBR having a Mooney viscosity $ML_{1+4}$(100° C.) of not greater than 35 is preferably used as the NBR.

This application corresponds to Japanese Patent Application No. 2015-202238 filed in the Japan Patent Office on Oct. 13, 2015, the disclosure of which is incorporated herein by reference in its entirety.

What is claimed is:

1. A semiconductive roller comprising a nonporous cross-linking product of a rubber composition which comprises:

a rubber component including only four types of rubbers consisting of an epichlorohydrin rubber, a chloroprene rubber, a butadiene rubber and an acrylonitrile butadiene rubber, wherein the butadiene rubber is present in a proportion of not greater than 55 parts by mass and the acrylonitrile butadiene rubber is present in a proportion of not less than 3 parts by mass based on 100 parts by mass of the overall rubber component.

2. The semiconductive roller according to claim 1, further comprising an oxide film provided in an outer peripheral surface thereof.

3. The semiconductive roller according to claim 2, which is a developing roller for an image forming apparatus.

4. The semiconductive roller according to claim 1, which is a developing roller for an image forming apparatus.

* * * * *